US007922267B2

(12) United States Patent
Gevaert

(10) Patent No.: US 7,922,267 B2
(45) Date of Patent: Apr. 12, 2011

(54) MOVABLE MONITOR AND KEYBOARD STORAGE SYSTEM FOR A WORKSURFACE

(75) Inventor: Steven C. Gevaert, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 629 days.

(21) Appl. No.: 11/837,332

(22) Filed: Aug. 10, 2007

(65) Prior Publication Data

US 2009/0039743 A1 Feb. 12, 2009

(51) Int. Cl.

| | |
|---|---|
| ***A47B 81/00*** | (2006.01) |
| ***A47B 97/00*** | (2006.01) |
| ***A47B 51/00*** | (2006.01) |
| ***A47B 57/00*** | (2006.01) |
| ***A47B 37/00*** | (2006.01) |

(52) U.S. Cl. ..... 312/223.3; 312/312; 108/50.01

(58) Field of Classification Search ..... 312/223.3, 312/304, 306, 312–316, 319.1–319.8, 322, 312/310, 311, 223.2; 108/50.01

See application file for complete search history.

(56) References Cited

U.S. PATENT DOCUMENTS

| | | | |
|---|---|---|---|
| 4,314,647 | A | 2/1982 | Harris et al. |
| 4,718,740 | A | 1/1988 | Cox |
| 4,828,342 | A | 5/1989 | Stefan |
| 4,836,623 | A | 6/1989 | Holland |
| 5,101,736 | A | 4/1992 | Bommarito et al. |
| D335,225 | S | 5/1993 | Ugalde |
| 5,242,217 | A | 9/1993 | Gonnet |
| 5,364,177 | A | 11/1994 | Ugalde |
| 5,368,377 | A | 11/1994 | Baines |
| 5,437,235 | A | 8/1995 | Randolph |
| 5,685,231 | A | 11/1997 | Eyre |
| 5,746,489 | A | 5/1998 | Moon |
| 5,758,849 | A | 6/1998 | Bui et al. |
| 5,758,935 | A | 6/1998 | Coonan |
| 5,957,059 | A | 9/1999 | Burhman |
| 6,059,385 | A | 5/2000 | Guhl |
| 6,170,406 | B1 | 1/2001 | Klein et al. |
| 6,327,983 | B1 | 12/2001 | Cronk et al. |
| 6,446,564 | B1 | 9/2002 | Anderson |
| 6,494,150 | B1 | 12/2002 | Phoenix et al. |
| 6,508,526 | B2 | 1/2003 | Reppas et al. |
| 6,609,465 | B2 | 8/2003 | Kolavo |
| 6,612,670 | B2 | 9/2003 | Liu |
| 6,846,052 | B2 | 1/2005 | Kelley et al. |
| 6,902,243 | B2 | 6/2005 | Bober |
| 6,913,332 | B1 | 7/2005 | Besterfield et al. |
| 7,207,278 | B2 | 4/2007 | Latino et al. |

(Continued)

*Primary Examiner* — Darnell M Jayne
*Assistant Examiner* — Timothy M Ayres
(74) *Attorney, Agent, or Firm* — Andrus, Sceales, Starke & Sawall, LLP

(57) ABSTRACT

A worksurface storage system includes a frame, a tray, an actuator, and a cover. The tray and actuator are connected to the frame such that operation of the actuator translates the actuator and the tray relative to the frame. The cover is pivotably connected to the frame such that translation of the tray rotates the cover between an open and a closed position relative to the worksurface. The storage system is constructed to engage the worksurface such that devices supported by the tray are selectively extended and retracted relative to the worksurface. An opening formed in the worksurface accommodates passage of the devices and the cover, which is rotationally connected to the frame and which covers the opening formed in the worksurface when the devices are not in use. The storage system provides for multi-functional use of the worksurface.

17 Claims, 9 Drawing Sheets

U.S. PATENT DOCUMENTS

| | | | | |
|---|---|---|---|---|
| 2002/0079788 | A1 | 6/2002 | Canedy et al. | |
| 2003/0193275 | A1 | 10/2003 | Canedy et al. | |
| 2003/0209955 | A1 | 11/2003 | Canedy et al. | |
| 2004/0221775 | A1 | 11/2004 | Okninski | |
| 2005/0002591 | A1 | 1/2005 | Buitmann | |
| 2006/0000955 | A1 * | 1/2006 | Cvek | 248/161 |
| 2006/0161993 | A1 * | 7/2006 | Cvek | 726/34 |
| 2008/0060560 | A1 * | 3/2008 | Chen | 108/50.01 |

* cited by examiner

MOVABLE MONITOR AND KEYBOARD STORAGE SYSTEM FOR A WORKSURFACE

FIELD OF THE INVENTION

The present invention relates to storage systems, and more specifically to an extendable and retractable worksurface storage assembly that is capable of selectively enclosing and exposing items, such as computer peripheral devices, from below a worksurface.

BACKGROUND OF THE INVENTION

Tables, desks and work stations have been modified in their construction in order to more readily accommodate computing devices such as desktop and laptop computers. While advancements in computer technology have resulted in a reduction in the size of computers and their associated displays, such devices still occupy significant space on a desk or tabletop when not being used. Oftentimes it is necessary to remove a computer and/or display from the desk or tabletop in order to enable an individual to effectively utilize the area of the desk or tabletop.

To avoid this problem, a number of known desks, tables and workstations have been developed in which the various devices associated with a computer can be selectively elevated above or lowered beneath the worksurface. These known assemblies include desks and tables in which one or multiple parts of the desk or table can be moved, generally vertically relative to the remainder of the working surface, in order to selectively expose a compartment containing a component of the computer, e.g., a monitor. When the compartment is exposed, the computer can be utilized in a conventional fashion. Further, when the compartment is in the retracted or stored position, the entire working surface area of the desk or table can be utilized for any desired purpose since the compartment and the computer component contained therein are entirely positioned beneath the surface of the desk or table.

However, these known tables or desks involve a relatively complex construction in order to accommodate the particular elevating mechanism and/or object retaining structure. Therefore, the costs and time required for the production of such desks or tables is quite high. Also, due to the significant number of components required, the maintenance and repair costs for such desks and tables are also significantly higher than the costs associated with conventional desks and tables that are used for supporting computers and associated peripheral devices.

Other prior art table and desk systems include structures configured to secure several of the components associated with a personal computer system to or on the worksurface, such as a keyboard holder and a monitor support. The monitor support is often located toward a rear of the worksurface whereas the keyboard support is commonly located adjacent a front area of the worksurface. Such storage systems further complicate the construction of the furniture system in requiring separate movable storage assemblies and also complicate the integration of the computer system within the furniture assembly. Providing multiple movable and/or pivotable assemblies for storing computer-related devices requires that the user route the associated connecting cables of the computer system in areas of the furniture assembly where the respective cables are not exposed or otherwise subjected to the potential for damage by the multiple movable parts associated with the storage assemblies. Providing multiple storage systems complicates the user's integration of a computer system with the furniture assembly and increases the potential for damage to the components of the computer system.

Another failing of some known worksurface assemblies with integrated storage systems is a lack of security for the electronic devices contained therein. Frequently, the end user must supply additional cables or the like to secure the stored components to the furniture assembly. This increases the user's expense and presents the potential that the security cable or the like may interfere with the operation of the storage.

Therefore, it is desirable to provide a worksurface furniture assembly that is capable of concealing a computer-related device within a desk or table structure, and which does not require that the desk or table be constructed in a manner significantly different than conventional furniture items of this type. Further, it is desirable to provide such a storage system that is constructed to allow the simple integration of computer-related devices therewith and to provide a simple and efficient means to secure such a device in the storage system.

SUMMARY OF THE INVENTION

The present invention is directed to a storage system that solves the aforementioned problems. A worksurface storage system includes a frame, a support such as a tray, an actuator, and a cover. The tray and actuator are connected to the frame such that operation of the actuator translates the actuator and the tray relative to the frame. The cover is pivotably connected to the frame such that translation of the tray rotates the cover between an open and a closed position relative to a worksurface. The storage system is constructed to engage a worksurface such that devices supported by the tray are selectively extended and retracted relative to the worksurface. An opening formed in the worksurface accommodates passage of the devices and the cover, and the cover is rotationally attached to the frame. The cover is operable to cover the opening in the worksurface when the device supported on the tray is not in use. Accordingly, the storage system provides for multi-functional use of the worksurface.

Therefore, according to one aspect of the invention, a powered storage system is disclosed that includes a frame constructed to be connected to a worksurface and a cover pivotably connected to the frame. The cover is constructed to be generally aligned with the worksurface when the frame is connected to the worksurface, and is movable between a first position and a second position. A tray is movably connected to the frame and has a first support and a second support connected to the tray. The first support is for supporting a display and the second support is for supporting a keyboard in an orientation generally aligned with an output surface of the display. An indexing mechanism is fixedly connected to the frame, and an actuator is connected to the tray and engaged with the indexing mechanism to move the tray and the cover during operation of the actuator.

Another aspect of the invention contemplates a worksurface assembly having a support structure connected to a worksurface for elevating the worksurface above a floor. A storage system is suspended from the worksurface below a cover. A platform is connected to the storage system and is movable between a stored position and an in-use position. A powered actuator is connected to the storage system and is constructed to move the platform between the stored position and the in-use position. The powered actuator is constructed to move with the platform as the platform moves between the stored position and the in-use position.

According to a further aspect of the invention, a method of forming a multi-purpose workstation is disclosed. The method includes providing a cover, pivotably connecting the cover to a frame, and connecting a tray to the frame. The tray is connected to the frame such that the tray can translate relative to the frame. The method includes operating an actuator such that the actuator translates with the tray during operation of the actuator. The cover is connected to the tray with a connector, such that translation of the tray rotates the cover. The cover is locked in an open position by the connector when the actuator is translated to an open end of travel position.

Numerous other aspects, features and advantages of the present invention will be made apparent from the following detailed description taken together with the drawing figures.

BRIEF DESCRIPTION OF THE DRAWINGS

The drawings illustrate the best mode presently contemplated of carrying out the invention. In the drawings.

DETAILED DESCRIPTION OF THE INVENTION

Figure 1:
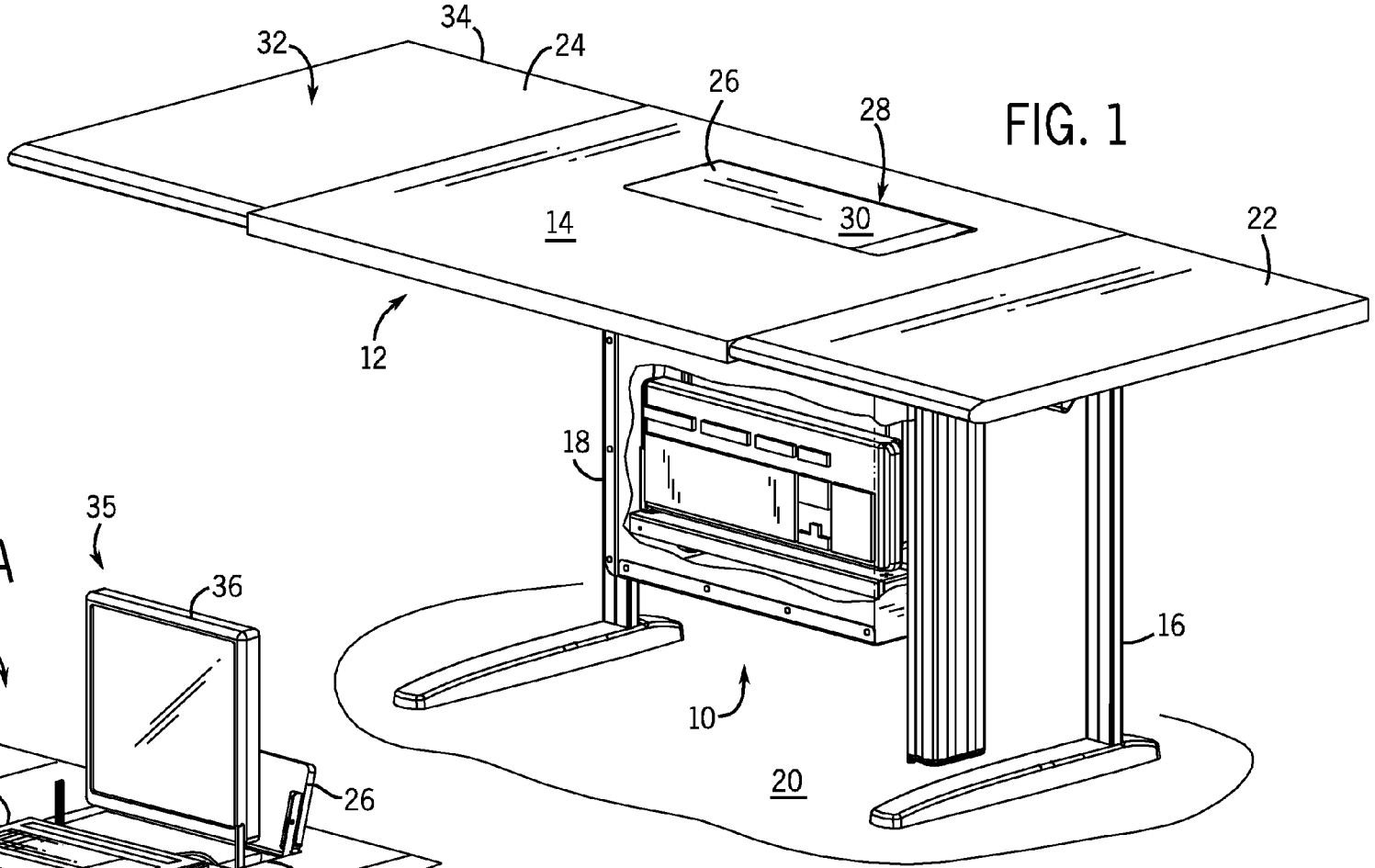
FIG. 1 is a perspective view of a worksurface equipped with a storage system according to the present invention.

FIG. 1 shows a powered storage system 10 according to the present invention attached to a worksurface 12. As shown in FIG. 1, storage system 10 is disposed beneath the top of worksurface 12, shown at 14, such that when the storage system is oriented in a closed, stored, or retracted position, the top surface 14 of worksurface 12 is unobstructed by storage system 10 or any devices supported by the storage system 10. A pair of supports 16, 18 are attached to worksurface 12 and elevate worksurface 12 above a floor 20. Supports 16, 18 may be extendable to allow worksurface 12 to be elevated a variable distance above floor 20, or may have a fixed height. Understandably, supports 16, 18 could be constructed to be interchangeable or telescopic to provide the desired height of worksurface 12 above floor 20. Worksurface 12 may include a one or more optional extensions, such as shown at 22, 24, which may extend from generally opposite sides of top surface 14 in order to expand the area of worksurface 12, if desired. Storage system 10 includes a cover 26 that is pivotably connected to the storage system and is disposed in an opening 28 formed through worksurface 12. When storage system 10 is the closed orientation as shown in FIG. 1, a top surface 30 of cover 26 is generally aligned with top surface 14 of worksurface 12, thereby providing a generally flat or planar work area 32 within a perimeter 34 of worksurface 12.

Figure 2A:
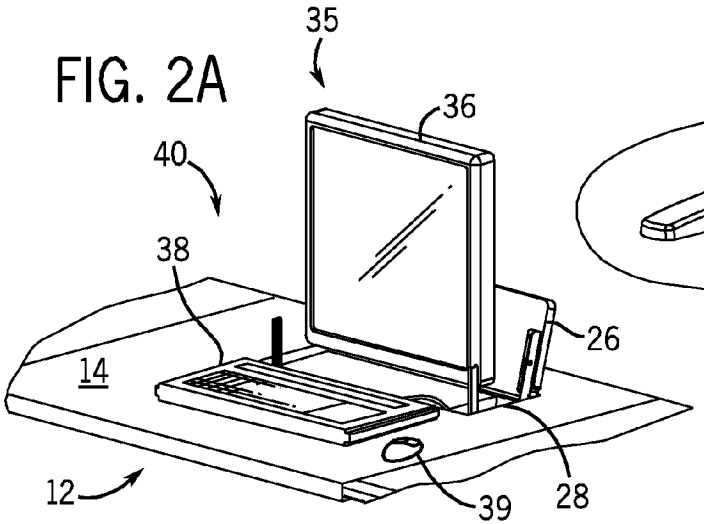
FIG. 2A is a perspective view of a portion of the worksurface shown in FIG. 1 with a display and keyboard in an in-use position.
Figure 2B:
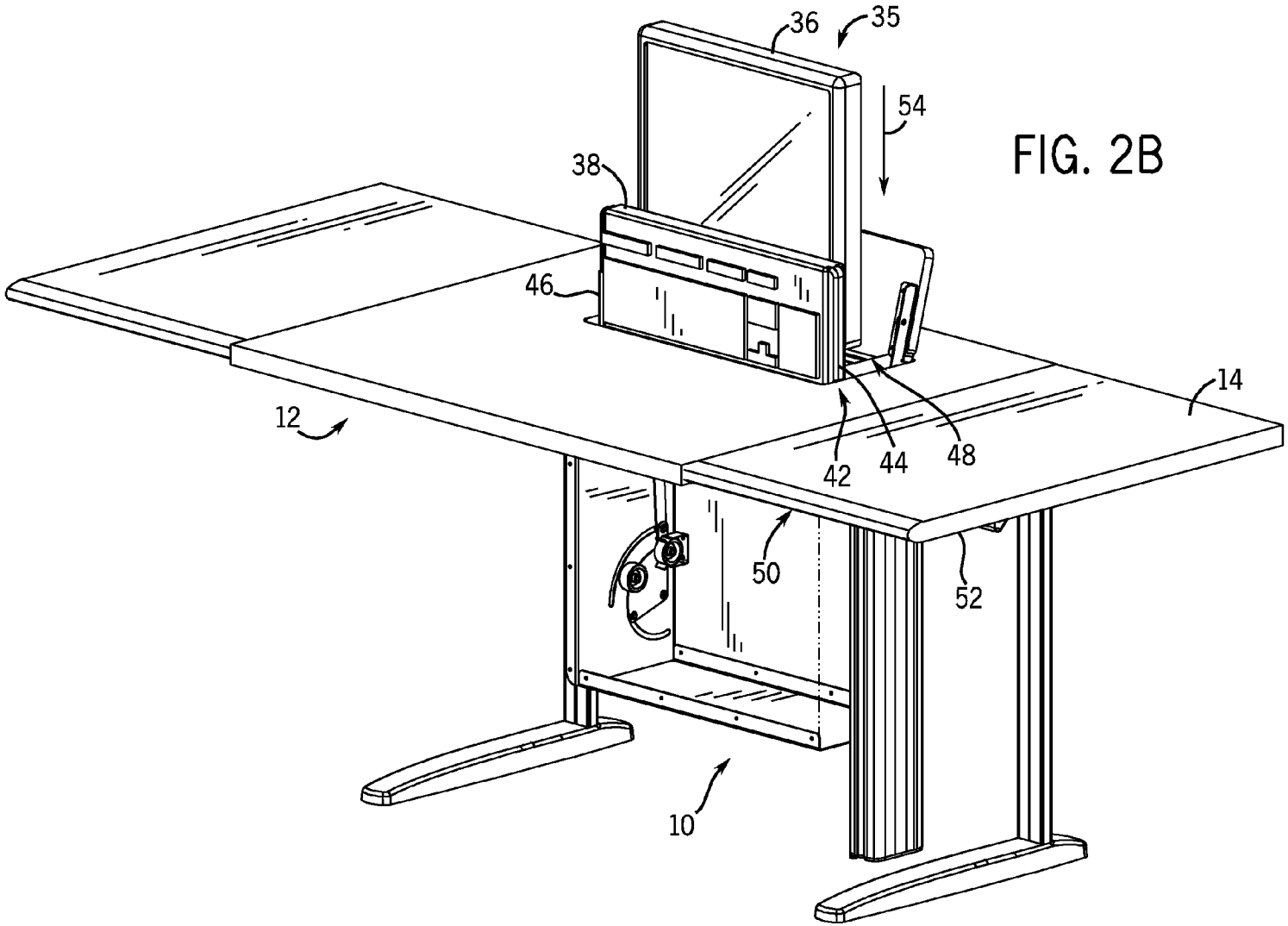
FIG. 2B is a perspective view of the worksurface shown in FIG. 1 with the keyboard and display being returned to a stored position generally beneath the worksurface.

As shown in FIG. 2A, when utilization of the devices enclosed by storage system 10 is desired, the devices 35, such as a display 36 a keyboard 38, and a mouse 39, are extended to a working orientation or in-use position 40. The devices 35 are extended from a stored position beneath top surface 14 through opening 28 formed in worksurface 12. Cover 26 rotates out of opening 28 to allow uninterrupted passage of display 36 and keyboard 38, and a mouse tray 41 (FIGS. 3, 4), which supports mouse 39, through opening 28. As shown in FIG. 2B, when non-use or storage of devices 35 is desired, storage system 10 includes a first portion 42 that is constructed to retain keyboard 38 and a second portion 48 constructed to support display 36 and mouse tray 41. First portion 42 includes a pair of adjustable keyboard retention brackets 44, 46 oriented to support keyboard 38 generally parallel to display 36. Such an orientation allows opening 28 to occupy a minimal cross-sectional area thereby increasing the uninterrupted area of top surface 14. A control 50, such as a switch attached to an underside 52 of worksurface 12, controls operation of storage system 10 to retract devices 35 through worksurface 12, as indicated at arrow 54.

Figure 3:
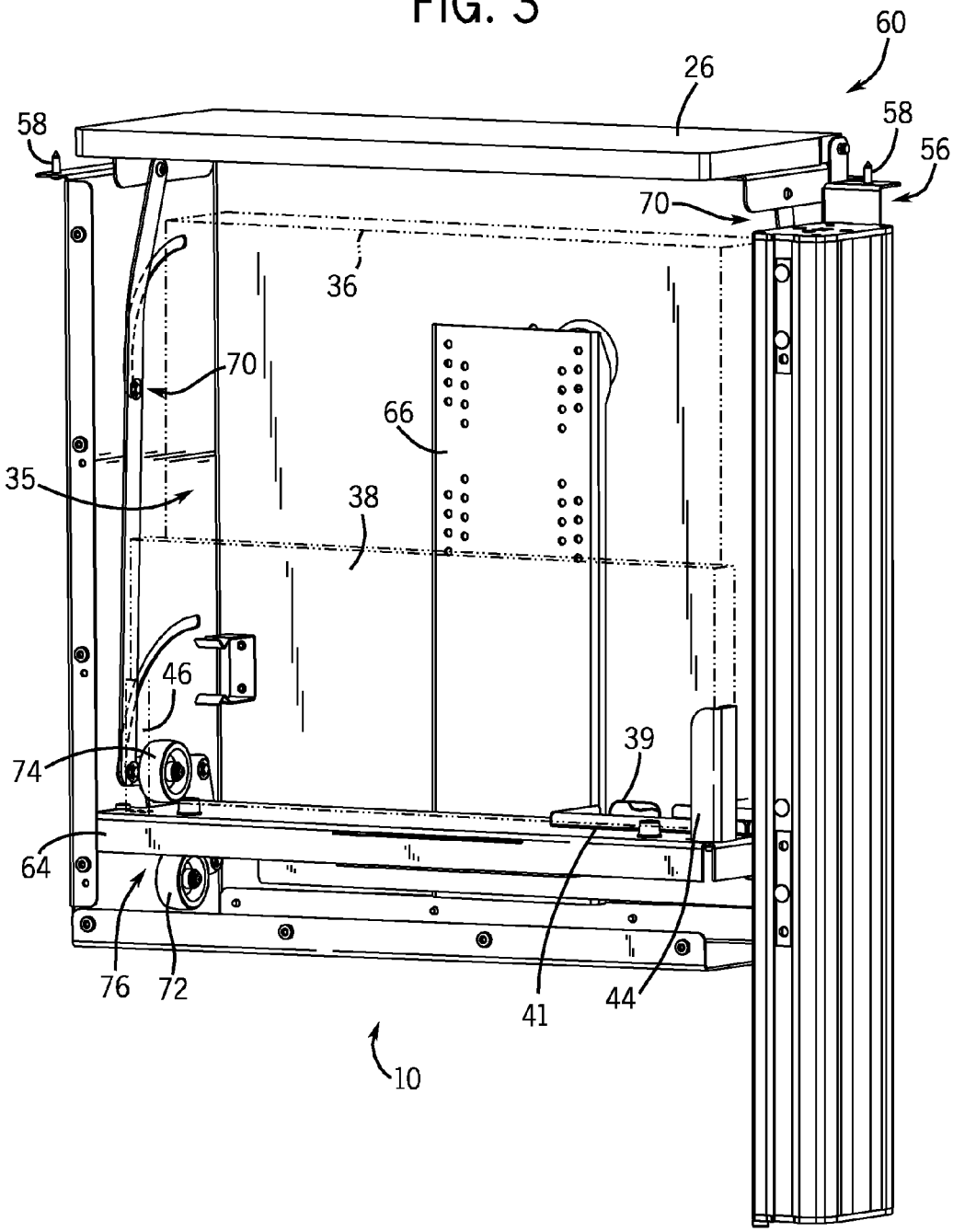
FIG. 3 is a perspective view of the storage system shown in FIG. 1 removed from the worksurface and oriented in a closed or stored position.
Figure 4:
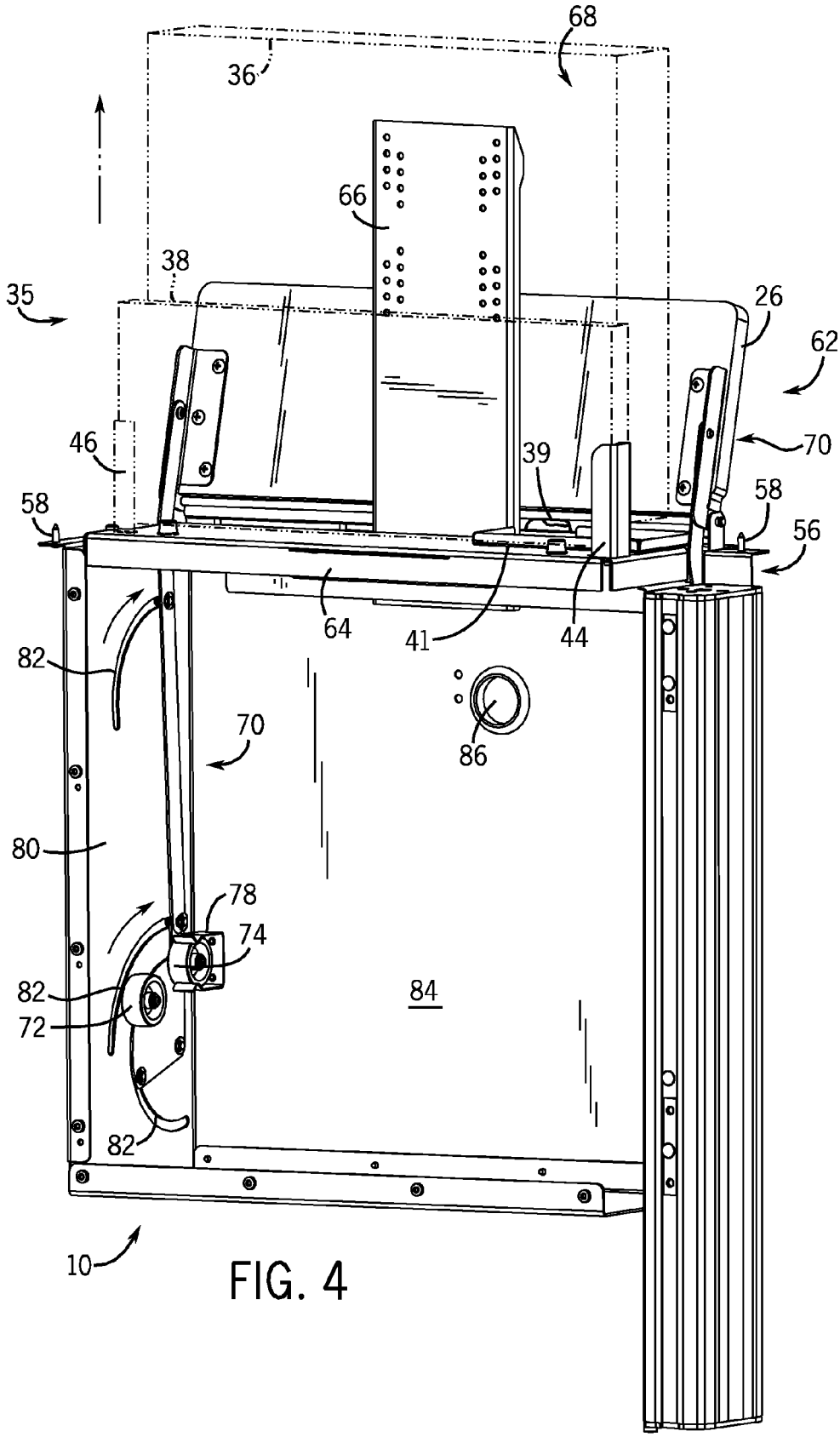
FIG. 4 is a perspective view of the storage system shown in FIG. 3 with the storage tray extended to an open or in-use position.

FIG. 3 shows storage system 10 removed from worksurface 12. Storage system 10 includes a frame 56 that is constructed to be secured to underside 52 of worksurface 12. A number of fasteners 58 extend through frame 56 and engage worksurface 12 such that the storage system 10 can be suspended from underside 52 of worksurface 12. Cover 26 is pivotably connected to frame 56 and is movable between a first or closed position 60 and, as shown in FIG. 4, a second or open position 62. Referring to FIGS. 3 and 4, storage system 10 includes a main support member, which may be in the form of a shelf or tray 64, constructed to support devices 35. A first support, which may be a display support 66, is connected to tray 64 and constructed to support display 36. A second support, which may be a keyboard support, is connected to tray 64 by keyboard retention brackets 44, 46 which are connected to tray 64 and are constructed to support keyboard 38.

A cover linkage 70 pivotably connects cover 26 to storage system 10, such that cover 26 does not interfere with the passage of devices 35 through opening 28. A pair of rollers 72, 74 are connected to cover linkage 70 and are constructed to guide and control the operation of cover linkage 70 relative to tray 64. As shown in FIG. 3, roller 72 is constructed to engage an underside 76 of tray 64 when the tray 64 is oriented in the stored position. Roller 74, as shown in FIG. 4, is constructed to engage a roller retainer 78 when tray 64 is moved to the open or in-use position. A side panel 80 of frame 56 includes a series of grooves 82 constructed to define the range of motion of cover linkage 70. Roller retainer 78 is attached to a rear panel 84 of frame 56 of storage system 10 and is oriented to allow uninterrupted passage of tray 64 and devices 35 past the roller retainer. A knockout of opening 86 is formed in rear panel 84 and constructed to allow the passage of electrical cables through rear panel 84. Such a construction allows the interconnection of devices 35 supported on tray 64 with devices external to storage system 10.

Figure 5:
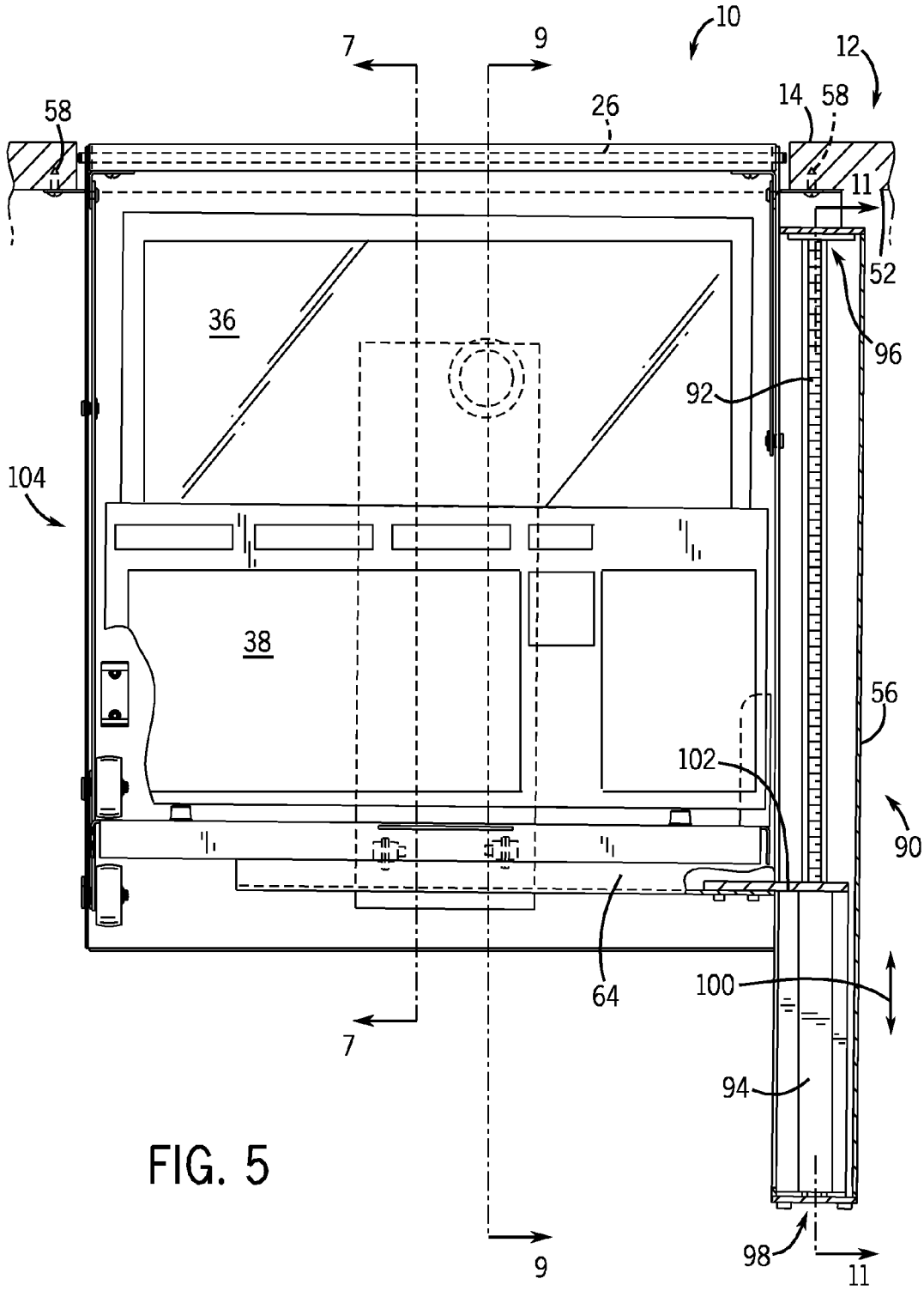
FIG. 5 is an elevational view of the storage system attached to the worksurface and oriented in the closed position.

Referring to FIG. 5, storage system 10 includes an actuator system 90 connected to frame 56. Actuator system 90 includes an indexing device or screw 92 and an actuator 94 constructed to move along screw 92. A first end 96 and a second end 98 of screw 92 are fixedly connected to frame 56 such that screw 92 does not rotate relative to storage system 10. Actuator 94, preferably a motor, engages screw 92 such that actuator 94 translates in a direction, indicated by arrow 100, relative to the screw during operation of the motor. A bracket 102 is connected between actuator 94 and tray 64 such that tray 64 moves with translation 100 of actuator 94. As shown in FIG. 5, storage system 10 is suspended from underside 52 of worksurface 12 and secured to the worksurface by fasteners 58. Cover 26 is generally aligned with top surface 14 of worksurface 12 and generally encloses display 36, keyboard 38 and mouse tray 41 beneath cover 26 when actuator 94 is positioned in the fully closed position 104 as shown in FIG. 5.

Figure 6:
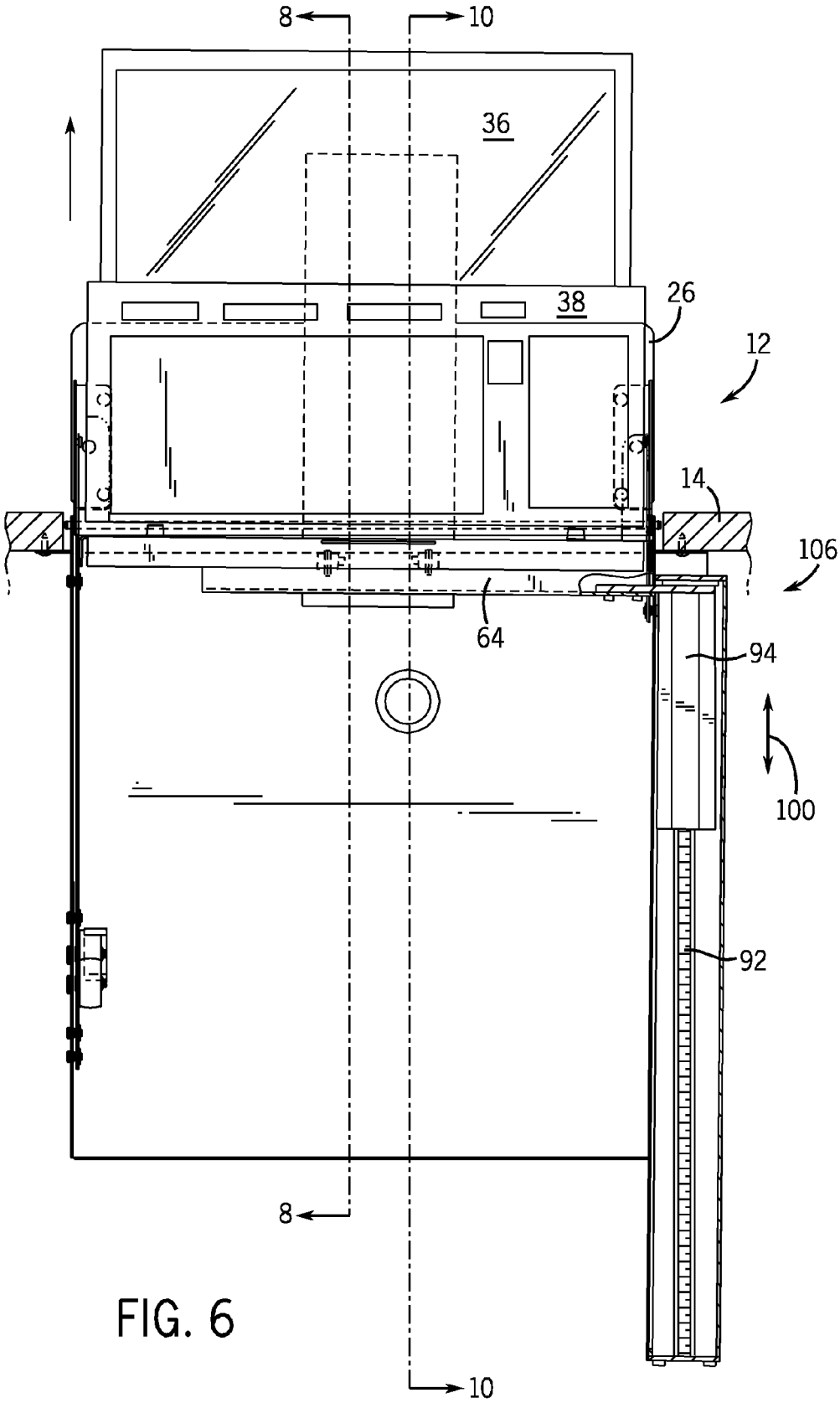
FIG. 6 is an elevational view similar to that of FIG. 5 with the storage system extended to the open or in-use position.

As shown in FIG. 6, actuator 94 is translatable along screw 92 and connected to tray 64 such that translation 100 of actuator 94 along screw 92 translates tray 64 relative to top surface 14 of worksurface 12. Accordingly, when actuator 94 is activated to expose display 36 and keyboard 38, actuator 94 moves along screw 92 to a fully extended or open position 106. The association of actuator 94 and screw 92 is described further below with respect to FIG. 11.

Figure 7:
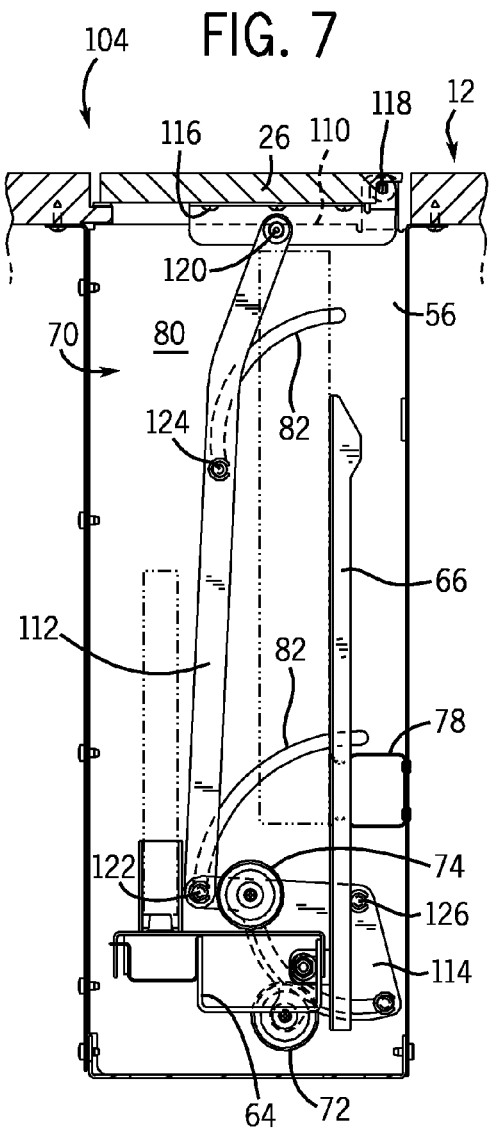
FIG. 7 is a section view of the storage system taken along line 7-7 of FIG. 5, showing a cover actuation system oriented in the closed position.
Figure 8:
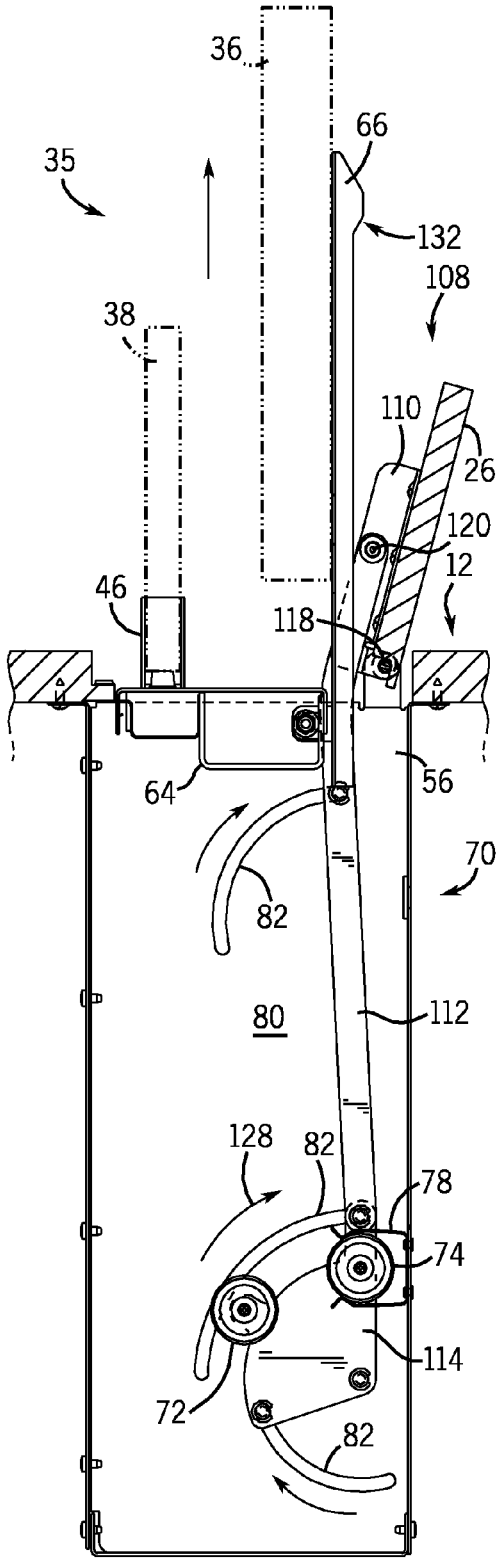
FIG. 8 is a view similar to that shown in FIG. 7 with the cover actuation system in the open position.

FIGS. 7 and 8 show the range of motion of the components of cover linkage 70 between the closed position 104, as shown in FIG. 7, and the open position 108, as shown in FIG. 8. Cover linkage 70 includes a cover bracket 110, a guide bracket 112, and a pivot bracket 114. A number of fasteners 116 secure cover bracket 110 to cover 26. A pin 118 connects cover 26 to frame 56 and allows the cover to rotate about the pin relative to frame 56. Guide bracket 112 is secured to cover bracket 110 with another pin 120 so that cover 26 rotates about pivot pin 118 during movement of guide bracket 112. An opposite end of guide bracket 112 is secured to pivot bracket 114 with a pivoting guide pin 122. Another guide pin 124 is disposed between the opposite ends of guide bracket 112. Guide pins 122, 124 engage grooves 82 formed in side panel 80. A pin 126 secures pivot bracket 114 to side panel 80 and allows pivot bracket 114 to pivot about pin 126 in response to movement of tray 64. Rollers 72, 74 attached to pivot bracket 114 for movement therewith interferingly engage tray 64 such that, as tray 64 is moved in an upward direction, roller 74 rotates in direction 128 into engagement with roller retainer 78 by allowing tray 64 to bypass roller 74. Engagement of roller 74 with roller retainer 78 defines a locked cover position and thus functions to maintain cover 26 in the open position. When storage of devices 35 is desired, an underside of tray 64 engages roller 72 during the downward translation of tray 64. The downward translation of tray 64 and the rotation of pivot bracket 114 disengages roller 74 from roller retainer 78.

Representatively, guide bracket 112 may be rotated to a position one degree past a vertical orientation, and maintained in position by engagement of roller 74 with roller retainer 78. Display support 66 is pivotably connected to tray 64 by a pivot connection 130, to allow movement of display 36 to a desired angular orientation in order to accommodate the height of the user and to reduce screen glare. Representatively, pivot connection 130 may provide a screen adjustment range of approximately fifteen degrees. When it is desired to store devices 35 in storage system 10, display support 66 is oriented in a generally vertical orientation. A projection 132 extends from display support 66 and includes a ramped lower surface that engages cover 26 to automatically return the pivoting monitor support bracket 66 to a vertical position when display support 66 is lowered and disengage the cover 26 from the locked position. The projection 132 also has a ramped upper surface, which pivots display support 66 to a vertical position when display support 66 is being raised, to prevent interference with cover 26.

Figure 9:
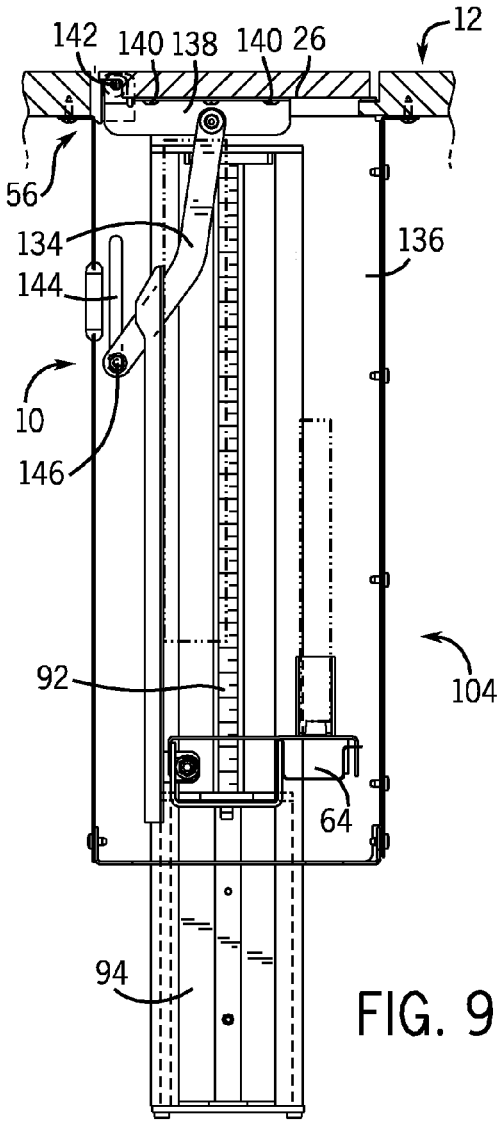
FIG. 9 is a section view of the storage system taken along line 9-9 of FIG. 5 with an actuation system oriented in the closed position.
Figure 10:
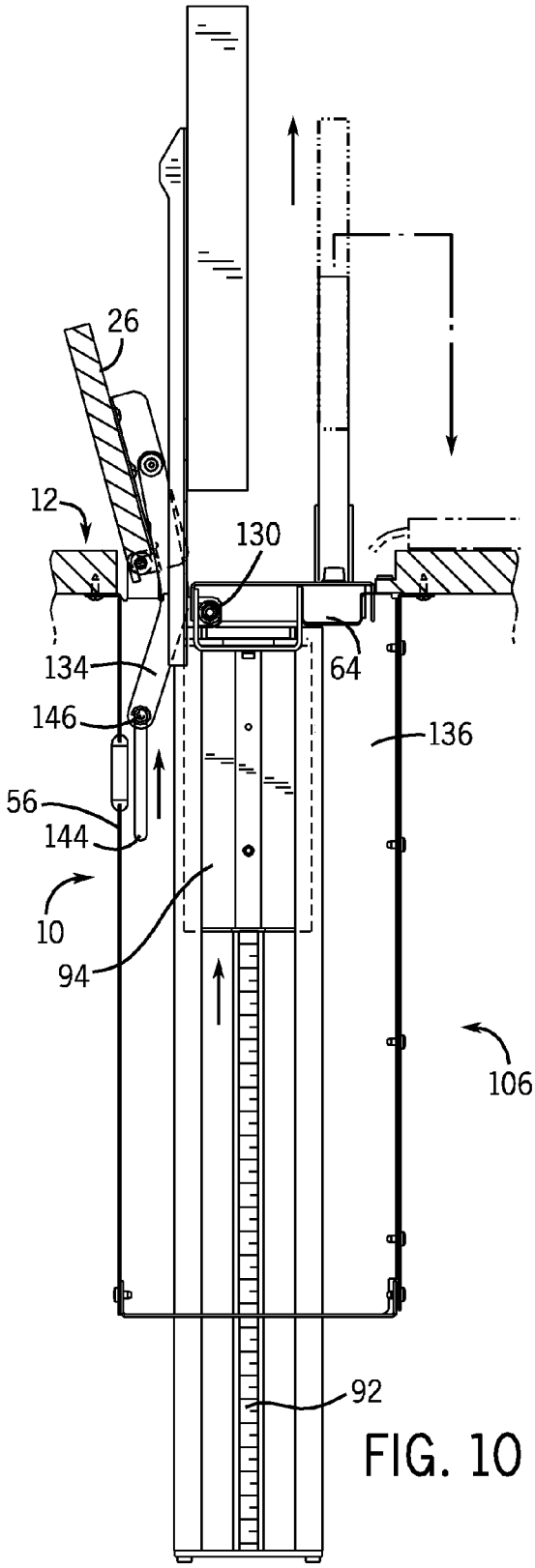
FIG. 10 is a section view similar to that shown in FIG. 9 with the actuation system oriented in the open position.

FIGS. 9 and 10 show the side of storage system 10 generally opposite the cover linkage 70. A guide bracket 134 is pivotably connected between a side panel 136 and a cover bracket 138. A number of fasteners 140 connect cover bracket 138 to cover 26. A pin 142 pivotably connects cover bracket 138 to frame 56 of storage system 10. Alternate ends of guide bracket 134 are pivotably and translatably connected to cover bracket 138 and frame 56, respectively. A pin 146 connects guide bracket 134 to frame 56 and engages a channel 144 formed in frame 56. Such a construction allows guide bracket 134 to translate and rotate relative to frame 56. As shown in FIGS. 9 and 10, translation of tray 64 between the closed position 104 and the open position 106 translates pin 146 in channel 144 during movement of cover 26. Accordingly, cover 26 is pivotably connected to frame 56 at opposite ends of the cover 26. Such a construction provides a robust and secure connection of the movable cover 26 to the worksurface 12. As shown in FIG. 10, upward movement of tray 64 engages and rotates the guide bracket 134 relative to the frame 56 to translate cover bracket 138 and cover 26.

Figure 11:
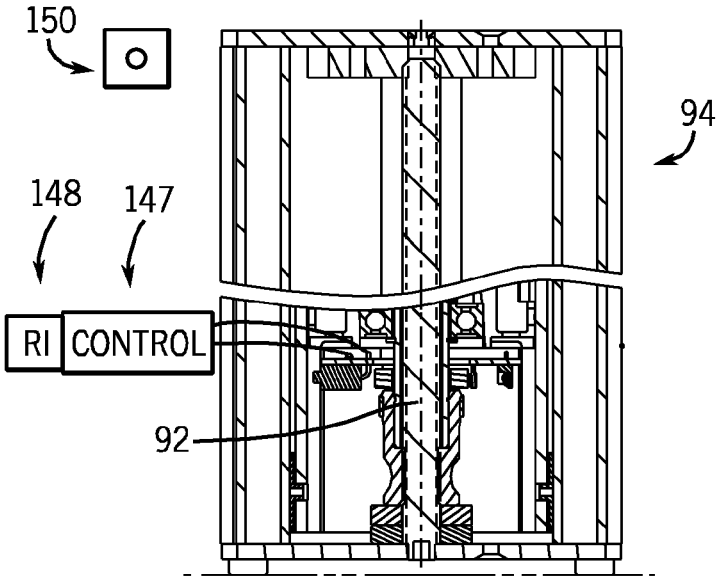
FIG. 11 is a partial cross-sectional view of the actuator system taken along line 11-11 of FIG. 5.

FIG. 11 shows a partial cross-sectional view of actuator 94. Actuator 94 is preferably in the form of a motor that is constructed to operatively engage screw 92 such that operation of actuator 94 translates the actuator 94 along the axis of screw 92. A control 147 is connected to actuator 94 and is constructed to allow selective operation of actuator 94. Control 147 may be constructed to provide an infinite vertical movement operation in which, by providing an open or close signal, actuator 94 may extend or retract to any desired position. Preferably, control 147 includes a remote interface 148 constructed to communicate with a remote control 150. Such a construction prevents unauthorized operation of storage system 10, to control utilization of devices 35 positioned therein. Such a configuration may be particularly desirable in educational environments to prevent unauthorized student access to devices secured by storage system 10. In addition, in an environment in which a number of storage systems 10 are provided to control access to computer peripheral devices by a number of persons, e.g. in an educational environment, control 147 and remote interface 148 may be configured to raise and lower all storage systems 10 simultaneously. In addition, the control 147 and remote interface 148 may be employed to lock all storage systems 10 in a closed position to prevent individual users from gaining access to the computer peripheral devices 35 supported by each storage system 10. This may be accomplished by cutting off the supply of power to the motor actuators 94 in response to a signal from remote interface 148, or in any other manner.

When cover 26 is in the fully open position, engagement of roller 74 with roller retainer 78 maintains cover 26 in the open position. In this manner, the user is able to operate actuator 94 to raise and lower tray 64, in order to raise and lower display 36 to a desired position according to user requirements, without moving cover 26 away from the open position.

When storage system 10 is being moved from the open position to the closed position, motor actuator 94 is operated so as to lower tray 64, which retracts display support brackets 66 and display 36, as well as keyboard retention brackets 44, 46 containing keyboard 38 and mouse tray 41 supporting mouse 39. The mouse tray 41 defines a third support interconnected with the second support, i.e. brackets 44, 46. When tray 64 attains a predetermined position as it is being lowered, the bottom of tray 64 comes into contact with roller 72 which, by operation of the pivot bracket 114, functions to move roller 74 out of engagement with roller retention bracket 78. Continued downward movement of tray 64 functions to move cover 26 toward and past a vertical orientation by operation of cover bracket 110 and guide bracket 112. When cover 26 is moved past the vertical orientation, cover 26 pivots about pivot pin 118, and is lowered by the force of gravity until roller 74 comes into contact with the upper surface of tray 64. As tray 64 continues its downward movement to retract the devices 35 interconnected with tray 64, roller 74 rides on the upper surface of tray 64 and cover 26 continues to be lowered under its own weight. This continues until tray 64 is fully lowered, so that cover 26 is moved to the closed position simply by the force of gravity. In this manner, in the event, 26 encounters an obstruction as it is being lowered, cover 26 is not being moved downwardly by the action of motor actuator 94, which could cause cover 26 to pinch the obstruction. instead, the obstruction is simply subjected to the relatively minimal weight of cover 26. When the obstruction is removed, and after motor actuator 94 has been operated to fully lower tray 64, cover 26 moves in downwardly to the closed position under the force of gravity.

In the event cover 26 is prevented from opening when it is desired to raise storage system 10, such as by the presence of a load on cover 26, the control 147 is configured to stop operation of motor actuator 94 when storage system 10 encounters a predetermined force that resists movement of cover 26 away from the closed position. This prevents motor actuator 94 from being burned out in the event an operator attempts to raise storage system 10 when cover 26 cannot be opened.

Therefore, one embodiment of the invention involves a powered storage system that includes a frame constructed to be connected to a worksurface and a cover pivotably connected to the frame. The cover is constructed to be generally aligned or flush with the worksurface when the frame is connected to the worksurface and is movable between a first position and a second position. A tray is movably connected to the frame, and a first support and a second support are connected to the tray. The first support is configured to support a display and the second support is configured to support a keyboard in an orientation generally aligned with an output surface of the display. The second support may also be configured to support an additional user-operated computer peripheral device, such as a computer mouse. An indexing mechanism is fixedly connected to the frame and an actuator is connected to the tray and engaged with the indexing mechanism to move the tray and the cover during operation of the actuator.

The invention also involves a worksurface assembly having a support structure connected to a worksurface for elevating the worksurface above a floor. A storage system is suspended from the worksurface proximate a cover forming a part of the worksurface. A platform is connected to the storage system and is moveable between a stored position and an in-use position. A powered actuator is connected to the storage system and is constructed to move the platform between the stored position and the in-use position. The powered actuator is constructed to move with the platform as the platform moves between the stored position and the in-use position.

The invention further involves a method of forming a multi-purpose workstation. The method includes providing a cover, pivotably connecting the cover to a frame, and connecting a tray to the frame. The tray is connected to the frame such that the tray can translate relative to the frame. The method also includes connecting an actuator to the tray such that the actuator translates with the tray during operation of the actuator. The cover is connected to the tray with a connector such that translation of the tray rotates the cover. The cover is locked in an open position by the connector when the actuator is translated to an open end of travel position.

Various alternatives are contemplated as being within the scope of the following claims particularly pointing out and distinctly claiming the subject matter regarded as the invention.

I hereby claim:

1. A powered worksurface storage system comprising:

a frame constructed to be connected to a worksurface;

a cover pivotably connected to the frame and constructed to be generally aligned with the worksurface when the frame is connected thereto and movable between an open position extending above the worksurface and a closed position in which the cover is aligned with the worksurface;

a tray movably connected to the frame between stored and in-use positions in which the tray is located beneath the worksurface;

a first support interconnected with the tray for supporting a display in a substantially vertical orientation beneath the cover in the closed position;

a second support interconnected with the tray for supporting a keyboard adjacent an output surface of the display in a substantially vertical orientation beneath the cover in the closed position lying parallel to the display;

an indexing mechanism interconnected with the frame;

an actuator directly connected to the tray for movement therewith and movable along the indexing mechanism to move the tray and the cover during operation of the actuator, and a pair of cover linkages movably connected between opposite ends of the cover and opposite sides of the frame, the cover linkages being engageable with the tray as driven by the actuator to move the cover to the open position, wherein one of the cover linkages includes a first cover bracket attached to one end of the cover, a first guide bracket having an upper end pivotally connected to the first cover bracket and a lower end pivotally mounted to a pivot bracket that is swingably secured to one side of the frame, the pivot bracket carrying first and second spaced rollers for receiving and engaging therebetween the tray in the stored position, the first guide bracket and the pivot arm being movably mounted on the one side of the frame along curved grooves formed therein, a back surface of the frame being provided with a roller retainer engageable and disengageable with the first roller; and whereby the actuator moves the tray from the stored position to the in-use position causing movement of the pivot bracket, the first guide bracket and the first cover bracket to pivot the cover to the open position with the first roller driven into engagement with the roller retainer to maintain the cover in the open position.

2. The powered storage system of claim 1 wherein the indexing mechanism is a screw and the actuator comprises a motor having an output that is movably engaged with the screw.

3. The powered storage system of claim 2 further comprising a remote control configured to control operation of the actuator.

4. The powered storage system of claim 1 wherein the first support engages the cover to disengage the cover from the locked position.

5. The powered storage system of claim 1 further comprising a switch constructed to be connected to the worksurface and connected to the actuator to control a position of the tray.

6. The powered storage system of claim 1 wherein the other of the cover linkages includes a second guide bracket rotatably connected to an opposite side of the frame and connected to a second cover bracket that is connected to the cover, wherein the tray is movable into engagement with the second guide bracket causing the second guide bracket to rotate relative to the frame and move along a vertically extending channel formed in the opposite side of the frame to translate the second cover bracket and the cover.

7. The powered storage system of claim 1, further comprising a third support interconnected with the second support, wherein the third support is configured to support a computer peripheral device such as a computer mouse.

8. A worksurface assembly comprising:

a worksurface;

a support structure connected to the worksurface for elevating the worksurface above a floor;

a frame suspended from the worksurface and having a cover pivotably connected to the worksurface and movable between an open position extending above the worksurface and a closed position aligned with the worksurface;

a platform connected to the frame and moveable between stored and in-use positions in which the platform is located beneath the worksurface;

a powered actuator directly carried by the platform and constructed to move the platform between the stored position and the in-use position, wherein the powered actuator is constructed to move with the platform as the platform moves between the stored position and the in-use position, and a pair of cover linkages movably connected between opposite ends of the cover and opposite sides of the frame, the cover linkages being engageable with the platform as driven by the actuator to move the cover to the open position, wherein the platform includes a first portion for supporting a display and a second position for supporting a keyboard such that the keyboard and the display are generally parallel to one another in a substantially vertical orientation when supported by the platform in the stored position, wherein one of the cover linkages includes a first cover bracket attached to one end of the cover, a first guide bracket having an upper end pivotally connected to the first cover bracket and a lower end pivotally mounted to a pivot bracket that is swingably secured to one side of the frame, the pivot bracket carrying first and second spaced rollers for receiving and engaging therebetween the platform in the stored position, the first guide bracket and the pivot arm being movably mounted on the one side of the frame along curved grooves formed therein, a back surface of the frame being provided with a roller retainer engageable and disengageable with the first roller; and wherein the other of the cover linkages includes a second cover bracket attached to another end of the cover, and a second guide bracket having an upper end pivotally secured to the second cover bracket and a lower end movably mounted to an opposite side of the frame along a vertically extending channel formed therein, whereby the actuator moves the platform from the stored position to the in-use position causing movement of the pivot bracket, the first guide bracket and the first cover bracket to pivot the cover to the open position with the first roller driven into engagement with the roller retainer to maintain the cover in the open position, and, at the same time, movement of the platform to the in-use position engages and rotates the second guide bracket to translate the second cover bracket and pivot the cover to the open position.

9. The worksurface assembly of claim 8 further comprising a shelf interconnected with the platform, wherein the shelf is configured to support a computer peripheral device such as a computer mouse.

10. The worksurface assembly of claim 8 further comprising a screw attached to the frame and engaged with the powered actuator such that the powered actuator translates along the screw relative to the storage system during operation.

11. The worksurface assembly of claim 10 wherein the powered actuator comprises a motor.

12. The worksurface assembly of claim 8 further comprising a display bracket connected to the platform and constructed to pivotably connect a display to the platform, wherein the display bracket is constructed to engage the cover as the platform is moved to the stored position so as to pivot the display bracket to a predetermined angular orientation.

13. The worksurface assembly of claim 8 wherein the support structure includes a plurality of telescopic legs.

14. A method of forming a multi-purpose workstation having a frame with an uppermost worksurface comprising the steps of:

a) providing a cover;

b) pivotably connecting the cover to the worksurface of the frame such that the cover is generally aligned with the worksurface when the cover is located in a closed position, and such that the cover extends above the worksurface when the cover is in an open position;

c) connecting a tray to the frame to allow translation between stored and in-use positions in which the tray is located beneath the worksurface;

d) connecting an actuator to the tray such that the actuator is movable along with the tray during operation of the actuator to move a display and a keyboard together in a substantially vertical and parallel relationship to one another;

e) providing a pair of cover linkages movably connected between opposite ends of the cover and opposite sides of the frame, wherein one of the cover linkages includes a first cover bracket attached to one end of the cover, a first guide bracket having an upper end d pivotally connected to the first cover bracket and a lower end pivotally mounted to a pivot bracket that is swingably secured to one side of the frame, the pivot bracket carrying first and second spaced rollers for receiving and engaging therebetween the tray in the stored position, the first guide bracket and the pivot arm being movably mounted on the one side of the frame along curved grooves formed therein, a back surface of the frame being provided with a roller retainer engageable and disengageable with the first roller; and wherein the other of the cover linkages includes a second cover bracket attached to another end of the cover, and a second guide bracket having an upper end pivotally secured to the second cover bracket and a lower end movably mounted to an opposite side of the frame along a vertically extending channel formed therein, f) engaging the cover linkages with the tray as driven by the actuator whereby the actuator moves the tray from the stored position to the in-use position causing movement of the pivot bracket, the first guide bracket and the first cover bracket to pivot the cover to the open position with the first roller driven into engagement with the roller retainer to maintain the cover in the open position, and, at the same time, movement of the tray to the in-use position engages and rotates the second guide bracket to translate the second cover bracket and pivot the cover to the open position; and g) securing the frame to a worksurface associated with the workstation.

15. The method of claim 14 further comprising connecting a control to an exterior of the worksurface and to the actuator to allow selective operation of the actuator.

16. The method of claim 14 further comprising providing a remote control configured to interface with the control to control operation of the actuator from a location remote from the worksurface.

17. The method of claim 14 further comprising pivotably interconnecting a display bracket raised and lowered with the tray, and engaging the display bracket with the cover to move the display bracket to a predetermined angular position upon operation of the actuator to lower the display bracket.

* * * * *

UNITED STATES PATENT AND TRADEMARK OFFICE

CERTIFICATE OF CORRECTION

PATENT NO. : 7,922,267 B2
APPLICATION NO. : 11/837332
DATED : April 12, 2011
INVENTOR(S) : Steven C. Gevaert It is certified that error appears in the above-identified patent and that said Letters Patent is hereby corrected as shown below:

In claim 14, column 10, line 47, after the word "end" and before the word "pivotally", delete "d".

Signed and Sealed this
Thirty-first Day of May, 2011

David J. Kappos

David J. Kappos
*Director of the United States Patent and Trademark Office*